US007463204B2

(12) United States Patent
Oshima

(10) Patent No.: US 7,463,204 B2
(45) Date of Patent: Dec. 9, 2008

(54) FEEDING STRUCTURE OF ANTENNA DEVICE FOR MOTOR VEHICLE AND ANTENNA DEVICE

(75) Inventor: Hideaki Oshima, Minato-ku (JP)

(73) Assignee: Nippon Sheet Glass Company, Limited, Tokyo (JP)

( * ) Notice: Subject to any disclaimer, the term of this patent is extended or adjusted under 35 U.S.C. 154(b) by 146 days.

(21) Appl. No.: 11/316,589

(22) Filed: Dec. 22, 2005

(65) Prior Publication Data

US 2006/0187131 A1 Aug. 24, 2006

(30) Foreign Application Priority Data

Dec. 24, 2004 (JP) ..... 2004-373115

(51) Int. Cl.
*H01Q 1/38* (2006.01)

(52) U.S. Cl. ..... 343/713; 343/700 MS

(58) Field of Classification Search ..... 343/713, 343/715, 700 MS, 711
See application file for complete search history.

(56) References Cited

U.S. PATENT DOCUMENTS 4,089,817 A * 5/1978 Kirkendall ..... 343/713
4,764,773 A * 8/1988 Larsen et al. ..... 343/713
5,905,471 A 5/1999 Biebl et al.
6,097,345 A 8/2000 Walton
2004/0178961 A1 9/2004 Maeuser et al.

FOREIGN PATENT DOCUMENTS

EP 1 437 792 A1 7/2004
WO WO 03/105278 A1 12/2003

OTHER PUBLICATIONS

International Search Report Feb. 24, 2006.

* cited by examiner

*Primary Examiner*—Michael C Wimer
(74) *Attorney, Agent, or Firm*—RatnerPrestia

(57) ABSTRACT

A structure for feeding a planar antenna formed on the surface of a window glass panel for a motor vehicle is provided. A dielectric substrate fixed in the module is mounted on the window glass panel so as to cover the planar antenna. A first capacitive feeding element opposed to the hot antenna element and a second capacitive feeding element opposed to the ground antenna are provided on the surface of the dielectric substrate at an antenna side. The planar antenna is fed through these antenna feeding elements. Air is present between the dielectric substrate and the planar antenna.

13 Claims, 10 Drawing Sheets

FEEDING STRUCTURE OF ANTENNA DEVICE FOR MOTOR VEHICLE AND ANTENNA DEVICE

BACKGROUND OF THE INVENTION

1. Field of the Invention

The present invention relates to a feeding structure of an antenna device formed on a window glass panel of a motor vehicle and an antenna device for a motor vehicle.

2. Related Art

Where an antenna for a band width of 1 GHz or more is formed on a window glass panel of a motor vehicle, it is desirable that the entire structure of an antenna device is implemented on the surface of a glass panel considering an antenna size. In this case, the antenna device is structured on one surface of a glass panel, because it is difficult to make a hole penetrating through the glass panel. An antenna formed on one surface of a glass panel is referred to as a planar antenna, one example thereof has been disclosed in Japanese Patent Publication No. 2004-214819.

Such planar antenna has been utilized for a Global Position System (GPS) antenna for receiving a signal designating a measured position from a GPS communication network for measuring the position of a motor vehicle utilizing an artificial satellite, a Dedicated Short Range Communication (DSRC) antenna utilized for a DSRC between a roadside radio equipment and a vehicle radio equipment, and an antenna for receiving a broadcast utilizing an artificial satellite or data delivered from various information service stations, for example.

In the planar antenna, the feeding point of the antenna is needed to be connected to an amplifier in a cavity module through a coaxial feeder in order to operate an antenna device.

FIG. 1 shows a pattern of a planar antenna 8 which is composed of a hot antenna element 10 and a ground antenna element 12 surrounding the hot antenna element 10.

The hot antenna element 10 comprises an approximately rectangular opening 14 at a central portion, the outline of the hot element 10 being approximately rectangular. Two opposing corners on one diagonal line of the hot element 10 are cut away, respectively, to form perturbed portions 16*a* an 16*b*.

The ground antenna element 12 comprises a rectangular opening 18 of a central portion, the outline thereof being rectangular. The hot antenna element 10 is located in the opening 18, and the outer periphery of the hot antenna element 10 is separated from the inner periphery of the ground antenna element 12. The planar antenna 8 is formed by a conductive material on the surface of a window glass panel of a motor vehicle.

A cavity module including an amplifier therein is mounted so as to cover the planar antenna 8. The module has a box-like shape including an opening opposed to the planar antenna 8, the inner portion thereof comprising an electronic circuitry including an amplifier. The amplifier is connected to the feeding points of the hot and ground antenna elements 10 and 12 by a coaxial feeder. These two feeding points are shown by one feeding point 19 as a representative in the figure.

The inner conductor of the coaxial feeder is connected to the hot antenna element 10 at the feeding point 19, while the outer conductor thereof is connected to the ground antenna element 12 at the feeding point 19. While respective feeding points of the hot and ground elements are provided with terminals, the attachment of the terminal to the feeding point is difficult because the size of each of the terminals is small. If a machine facility such as a robot is used for the attachment of a terminal, the manufacturing cost becomes high.

If the feeding point of the planar antenna 8 is directly connected to the amplifier in the module through a coaxial feeder, the module is not detachable from the planar antenna due to the presence of the coaxial feeder. To resolve this problem, a connector is inserted in the coaxial feeder between the feeding point of the planar antenna and the amplifier, resulting in the increasing number of components and the high cost.

In order to resolve above-described problems, it is conceivable that a capacitive feeding method may be utilized as a feeding method for a planar antenna. In this case, two capacitive feeding elements which are electrodes for capacitive feeding are provided respectively opposing to a hot antenna element and ground antenna element of a planar antenna in such a manner that the positional relationship of these capacitive feeding elements with respect to the planar antenna is to be held precisely and stably. For this purpose, the capacitive feeding elements are integrated with the cavity module mounted so as to cover the planar.

An object of the present invention is, therefore, to provide a feeding structure having a mechanism to attach the feeding structure to a cavity module.

Another object of the present invention is to provide an antenna device for a motor vehicle comprising such a feeding structure.

SUMMARY OF THE INVENTION

Two capacitive feeding elements opposing to a hot and ground antenna elements of a planar antenna are formed on the surface of a dielectric substrate.

The dielectric substrate is fixed in a cavity module in such a manner that the dielectric substrate is positioned at a predetermined distance far from the planar antenna in a direction perpendicular thereto. In this case, it is important that an air layer is present between the dielectric substrate and the planar antenna.

The dielectric substrate is required to be positioned at a predetermined distance with respect to the planar antenna. However, even if the position of the dielectric substrate is dispersed, the performance of the planar antenna is stable due to the presence of the air layer. The thickness of the air layer is preferably 0.3 mm or more, because the stability of the planar antenna performance is held even if the positional dispersion of the dielectric substrate is caused.

It is conceivable that the dielectric substrate is directly in contact with the planar antenna without providing an air layer. In this structure, a gap is caused between the planar antenna and the dielectric substrate due to the positional dispersion of the dielectric substrate while the cavity module is mounted. Therefore, a high performance is required for mounting the cavity module in order to make the antenna performance stable.

It is also required that the capacitive feeding elements are connected to the amplifier in the cavity module through a feeder such as a coaxial feeder. The amplifier is provided at the side opposite to the antenna side of the dielectric substrate, so that a conductive path is formed in the dielectric substrate or a penetrating hole through which a feeder passed is opened in the dielectric substrate in the case that the capacitive feeding elements are provided on the surface of the dielectric substrate at an antenna side.

In the case that the capacitive feeding elements are provided on the surface of the dielectric substrate opposite to the surface thereof at an antenna side, a feeder may be connected to the capacitive feeding elements.

Therefore, the present invention relates to a feeding structure of an antenna device for a motor vehicle for feeding a planar antenna including a hot antenna element and ground antenna element formed on one surface of a window glass panel for the motor vehicle from a cavity module, the module being mounted on the window glass panel so as to cover the planar antenna. The feeding structure comprises a dielectric substrate fixed in the module, a first capacitive feeding element provided on the surface of the dielectric substrate and opposed to the hot antenna element, and a second capacitive feeding element provided on the surface of the dielectric substrate and opposed to the ground antenna element, wherein air is present between the dielectric substrate and the planar antenna.

BEST MODE FOR CARRYING OUT THE INVENTION

An embodiment of a feeding structure of an antenna device according to the present invention will now be described with reference to the drawings.

Figure 2A:
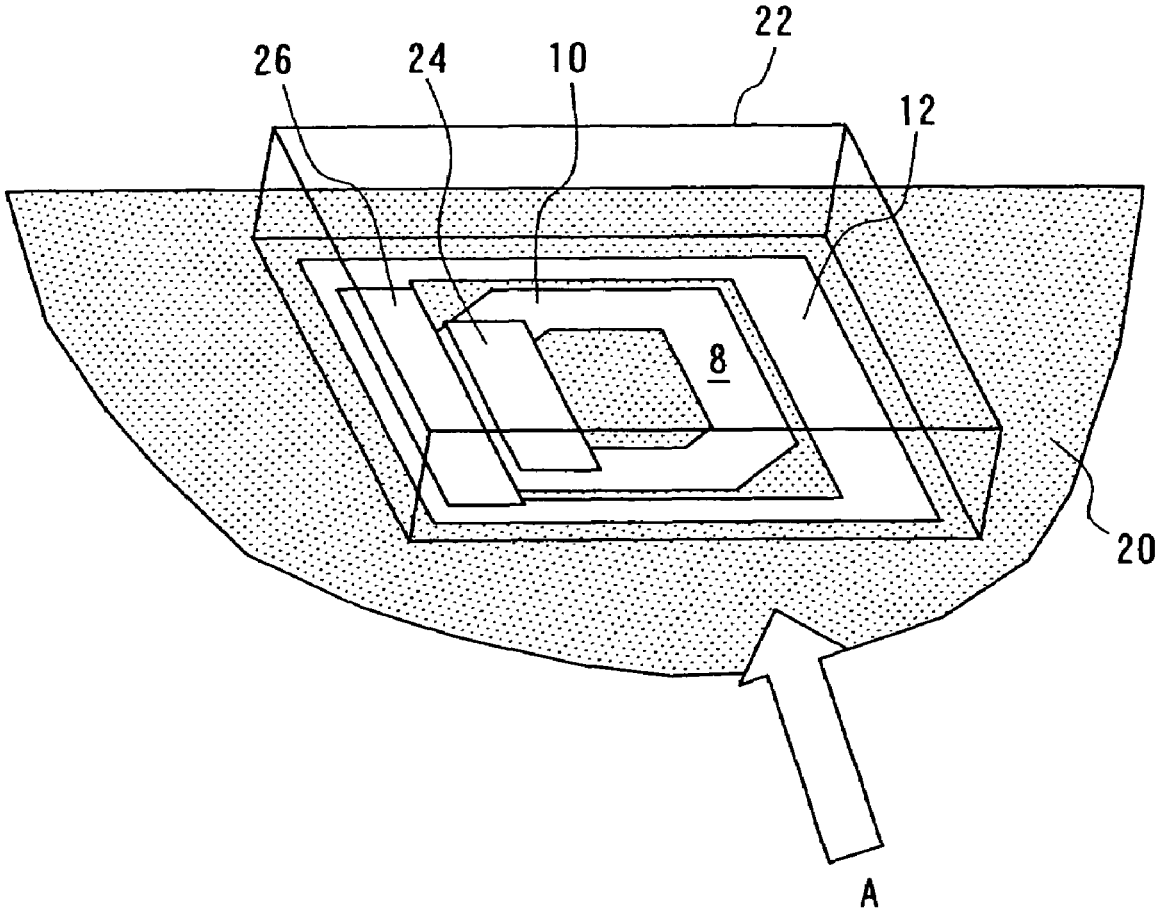
FIG. 2A shows a perspective view of a capacitive feeding structure according to the present invention.
Figure 2B:
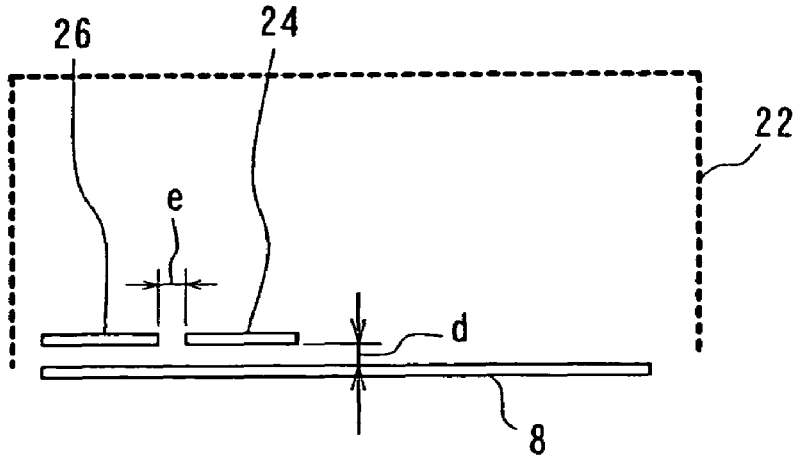
FIG. 2B shows a schematic side view in a direction designated by an arrow A in FIG. 2A.

FIGS. 2A and 2B show a fundamental structure of a capacitive coupling feeding structure according to the present invention. FIG. 2A is a perspective view and FIG. 2B a schematic side view in a direction designated by an arrow A in FIG. 2A.

Figure 1:
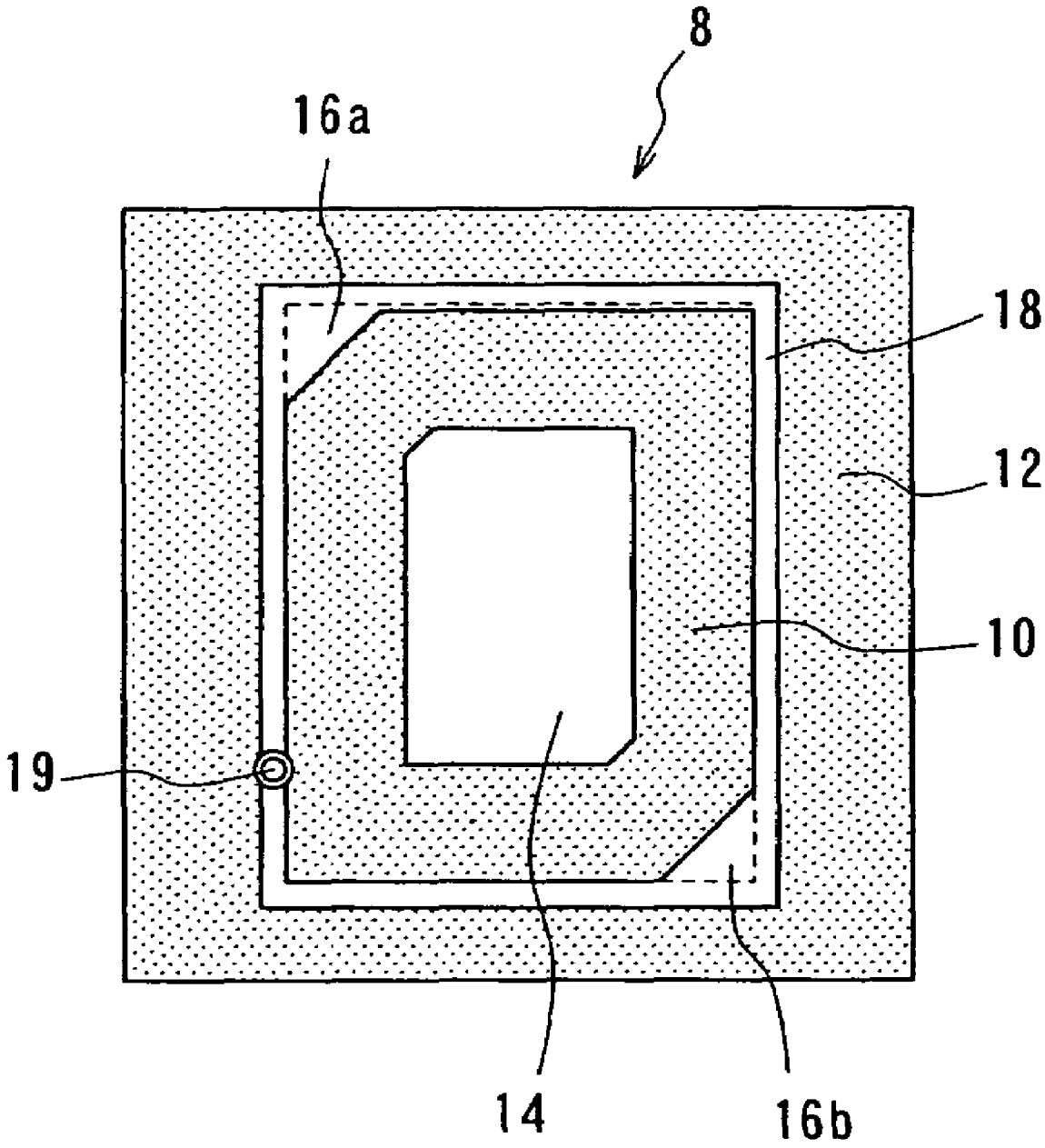
FIG. 1 shows a pattern of a planar antenna.

In the figure, reference numeral 20 shows a window glass panel. On one surface of the glass plate, there is provided the planar antenna 8 illustrated in FIG. 1. A cavity module 22 is mounted so as to cover the planar antenna 8, the module being shown only by a dotted-line for simplifying the drawing.

The module 22 has a box-like shape including an opening opposed to the planar antenna 8, an electronic circuitry including an amplifier (not shown) being provided therein.

Two feeding elements 24, 26 are provided opposing to the planar antenna 8 in the module 22 with being integral thereto. These feeding elements are formed by rectangular electrodes consisting of a conductive material such as copper or gold.

In the structure shown in FIGS. 2A and 2B, the feeding element 24 is opposed to the hot antenna element 10, and the feeding element 26 is opposed to the ground antenna element 12. The feeding element 24 is capacitively coupled to the hot antenna element 10, and the feeding element 26 to the ground antenna element 12. The distance between each of the feeding element and the planar antenna is selected to be a predetermined value d as shown in FIG. 2B. Air is present between each of the feeding element 24, 26 and the planar antenna 8. The feeding elements 24 and 26 are arranged in parallel to each other across a predetermined gap e.

The capacitive feeding elements described above are attached integrally to the cavity module 22. Hereinafter, an mechanism for attaching the feeding structure to the cavity module 22 will be described.

Figure 3:
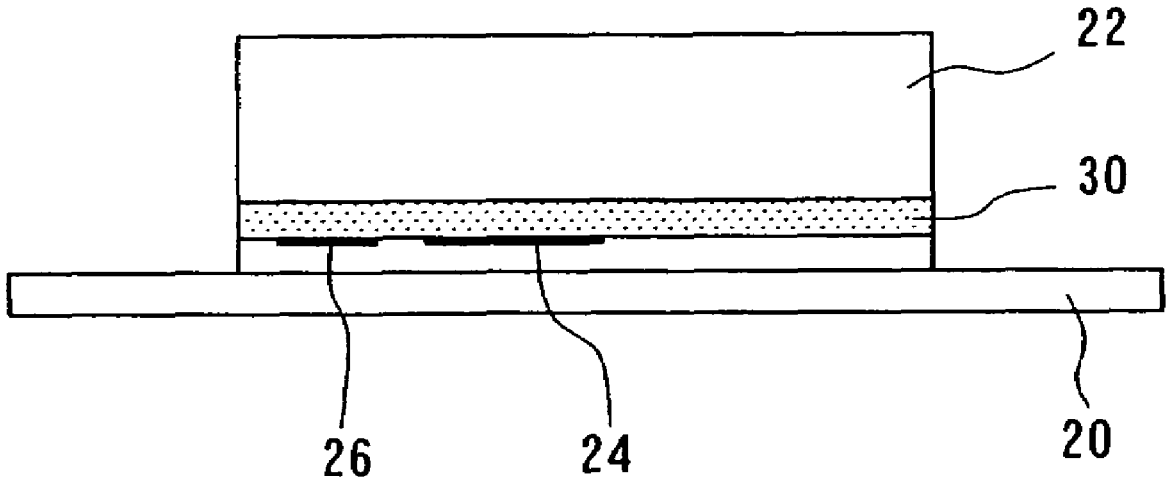
FIG. 3 shows a mechanism for attaching the feeding structure to the cavity module.

FIG. 3 shows a mechanism for attaching the feeding structure in which the capacitive feeding elements 24 and 26 are formed on a dielectric substrate 30 to the cavity module 22 by holding the dielectric substrate 30 in the cavity module 22.

The capacitive feeding elements 24 and 26 made of a conductive material are formed on the surface of the dielectric substrate 30 at an antenna side by an etching process. The dielectric substrate 30 is fixed at a predetermined position in the module 22. Thereafter, the module 22 is mounted to the planar antenna at a predetermined positional accuracy, so that the positional relationship between the capacitive feeding elements and the planar antenna may be held stably.

The capacitive feeding elements 24 and 26 formed on the surface of the substrate 30 at an antenna side are electrically connected to an amplifier (not shown) in the module 22. Since the amplifier is present above the dielectric substrate 30, it is required that a conductive path is formed in the dielectric substrate, and the conductive path is connected to a feeder.

Figure 4A:
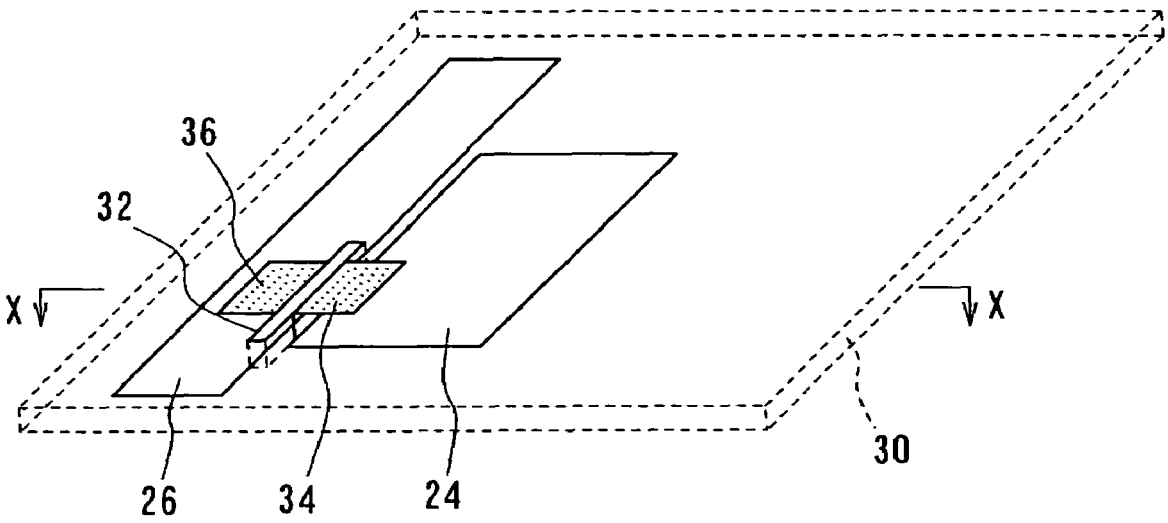
FIG. 4A shows an example of a conductive path on the wall of an opening.

FIG. 4A shows the feeding structure in which an elongated opening 32 penetrating through the dielectric substrate 30 is provided, and conductive paths 34 and 36 are formed through the opening.

Figure 4B:
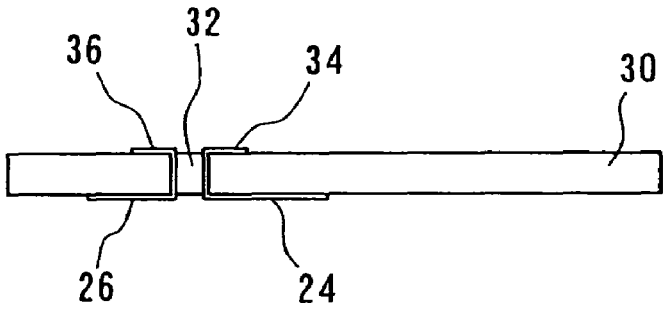
FIG. 4B is a cross-sectional view taken along X-X line in FIG. 4A.

FIG. 4B is a cross-sectional view taken along X-X line in FIG. 4A, and shows the shape of the conductive paths 34 and 36. The conductive path 34 starts from the capacitive feeding element 24, passes through the side wall of the opening 32, and is folded toward the opposite surface of the dielectric substrate 30. Also, the conductive path 36 starts from the capacitive feeding element 26, passes through the side wall of the opening 32, and is folded toward the opposite surface of the dielectric substrate. The portions of the conductive paths 34 and 36 on the opposite surface of the dielectric substrate 30 constitute connecting lands. Feeders are connected to the connecting lands, respectively.

Figure 5:
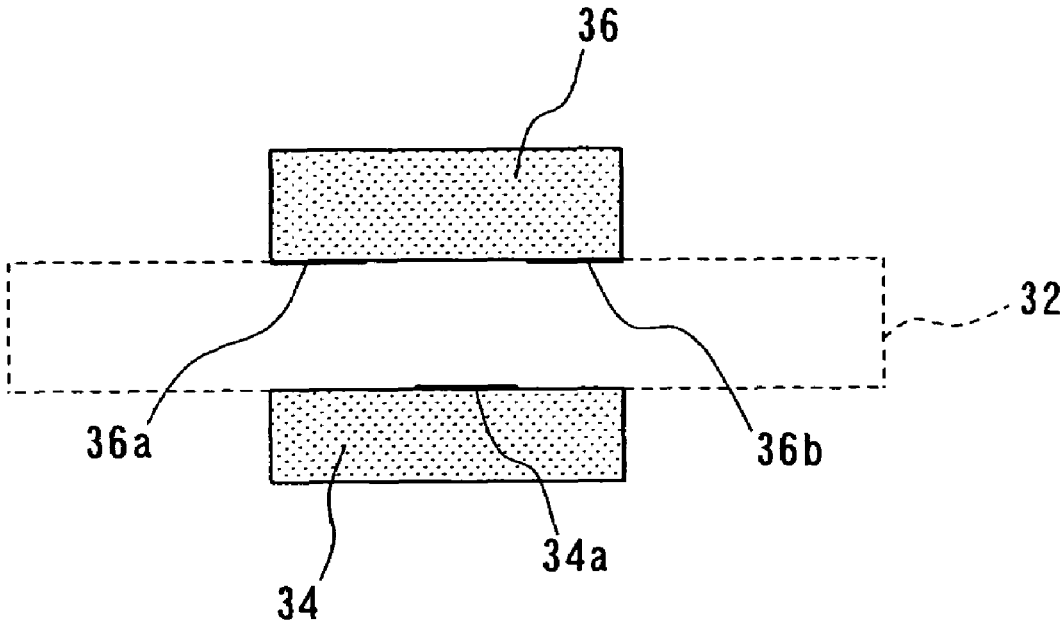
FIG. 5 shows another example of a conductive path on the wall of an opening.

In the structure described above, the conductive paths opposing to each other on the side wall of the opening 32 have the same width, and a capacitive coupling is generated therebetween. In order to decrease this capacitive coupling, the conductive portions on the side wall of the opening 32 are disposed alternately as shown in FIG. 5. In the figure, the conductive path 34 is composed of one conductive portion 34*a*, and the conductive path 36 is composed of two conductive portions 36*a* and 36*b*.

The conductive portion 34*a* on one side wall is not opposing to the conductive portions 36*a* and 36*b* on the other side wall, so that the capacitive coupling in FIG. 5 may be smaller than that in FIG. 4A.

Figure 6:
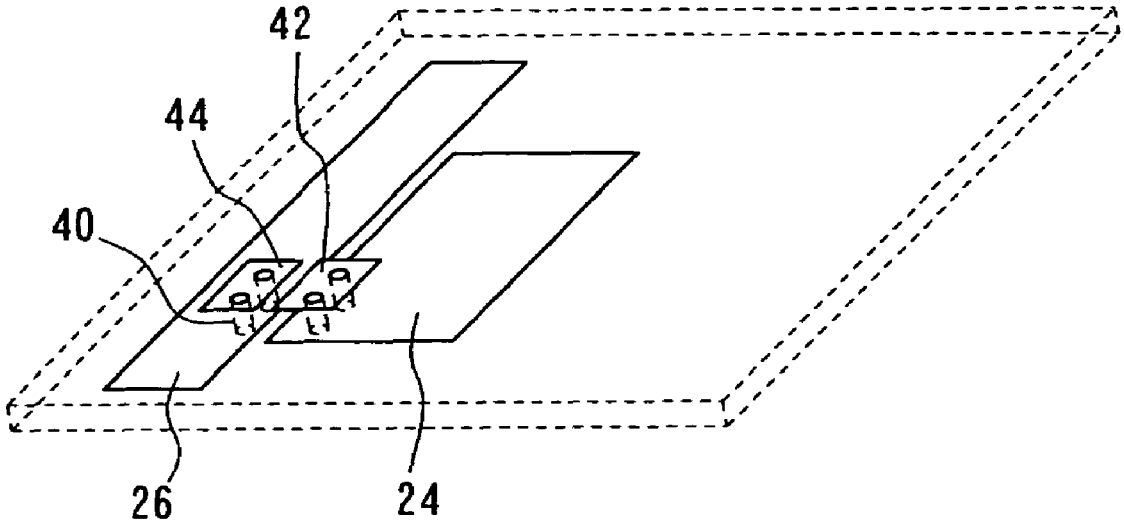
FIG. 6 shows another example of a conductive path formed in the dielectric substrate.

FIG. 6 shows another example of a conductive path formed in the dielectric substrate. In this example, at least one through hole 40 (two through holes in the figure) are opened in the dielectric substrate 30 with respect to each of the capacitive feeding elements 24 and 26. A through hole technique is usually used for a multi-layer circuit board, and the inner surface of the through hole is coated by a conductive material.

Connecting lands 42 and 44 are formed on the surface of the dielectric substrate 30 opposite to the surface on which the capacitive feeding elements 24 and 26 are formed. The capacitive feeding elements 24 and 26 are electrically connected to the lands 42 and 44, respectively, via the through holes 40. A feeder is connected to the lands 42 and 44.

Figure 7:
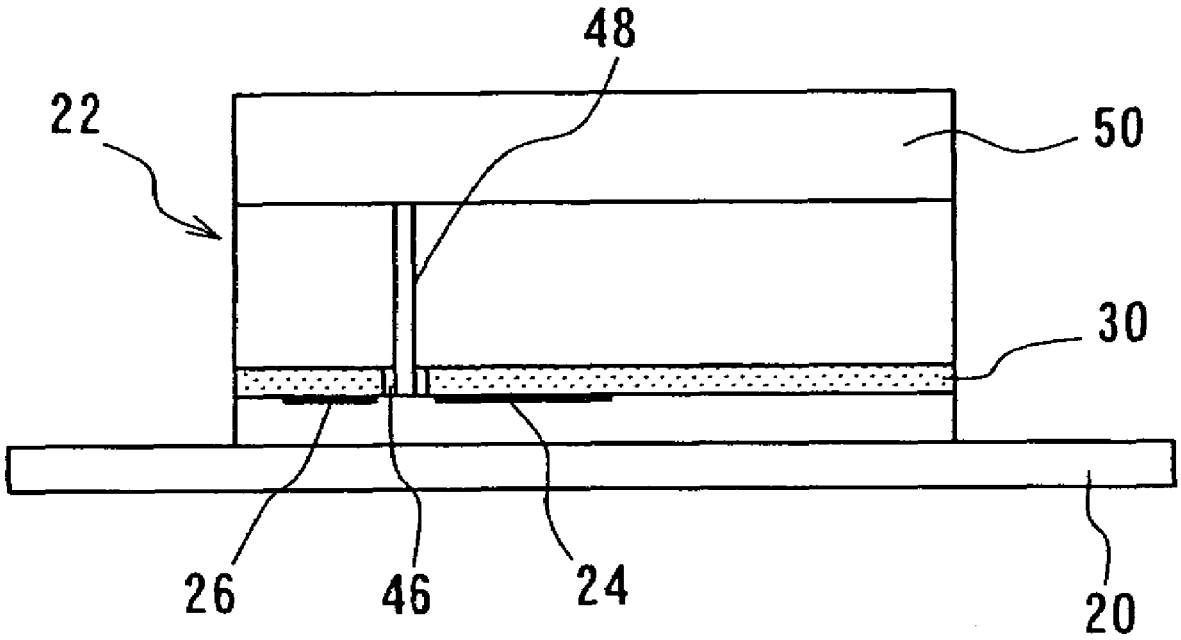
FIG. 7 shows the structure in which a coaxial feeder is provided passing through a penetrating hole to be connected to the capacitive feeding elements.

FIG. 7 shows the structure in which a penetrating hole 46 is opened in the portion of the dielectric substrate 30 between the capacitive feeding elements 24 and 26, and a coaxial feeder 48 is provided passing through the penetrating hole 46 so as to be connected to the capacitive feeding elements 24 and 26. The inner conductor of one end of the coaxial feeder is connected to the capacitive feeding element 24, and the outer conductor thereof to the capacitive feeding element 26. The other end of the coaxial feeder is connected to an amplifier 50 in the cavity module 22.

As a dielectric substrate used in each structure described above, a Teflon® substrate, glass epoxy substrate, ceramic substrate, or glass substrate, for example, may be utilized.

Air is present between the capacitive feeding elements and the planar antenna in the structures described above. Therefore, even if the material of a dielectric substrate is modified, the shift of an antenna resonance frequency is small, resulting in an easy regulation of a pattern of the planar antenna.

The dielectric substrate on which the capacitive feeding elements are formed is fixed integrally to the cavity module 22. As a fixing means, a machine screw fixing, a protrusion fixing, a folded tongue fixing, a spacer fixing, and the like may be utilized.

Figure 8:
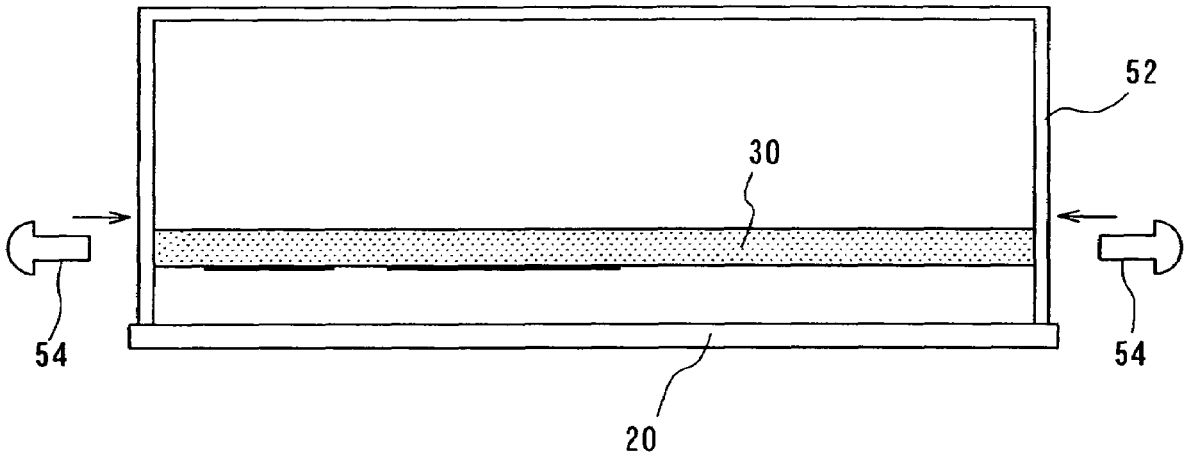
FIG. 8 shows the structure in which the dielectric substrate is fixed to a box-like frame by means of machine screws.

FIG. 8 shows the structure in which the dielectric substrate is fixed to a box-like frame 52 by means of machine screws 54 which are screwed from the outside of the frame 52, the frame 52 constituting an outer wall of the cavity module.

Figure 9:
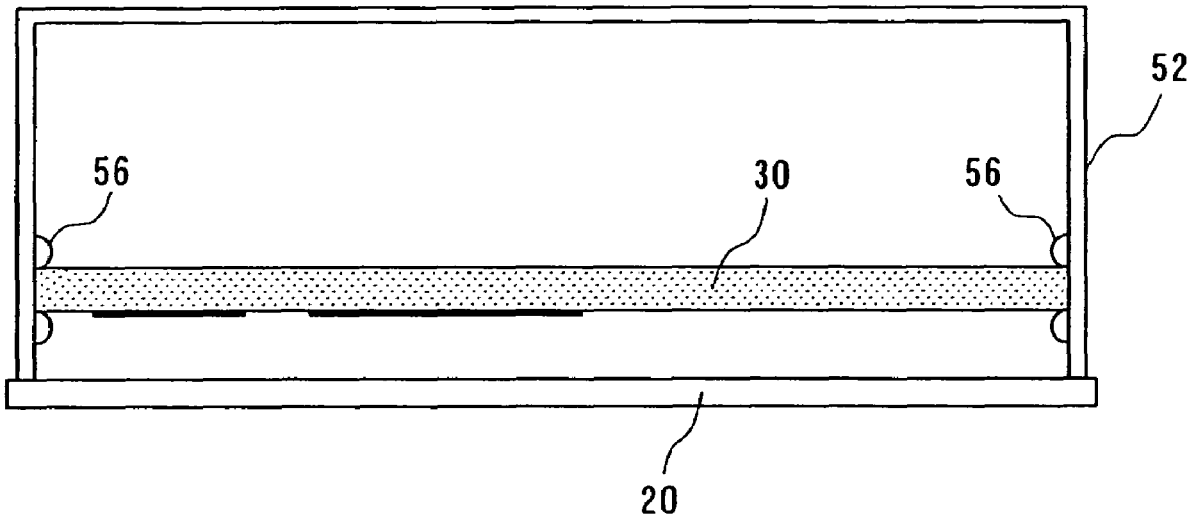
FIG. 9 shows the structure in which the dielectric substrate is held by the protrusions.

FIG. 9 shows the structure in which protrusions 56 are formed on the inner surface of the frame 52 by punching a punch (not shown) toward the inside of the frame from the outside thereof, and the dielectric substrate 30 is held by these protrusions 56.

Figure 10A:
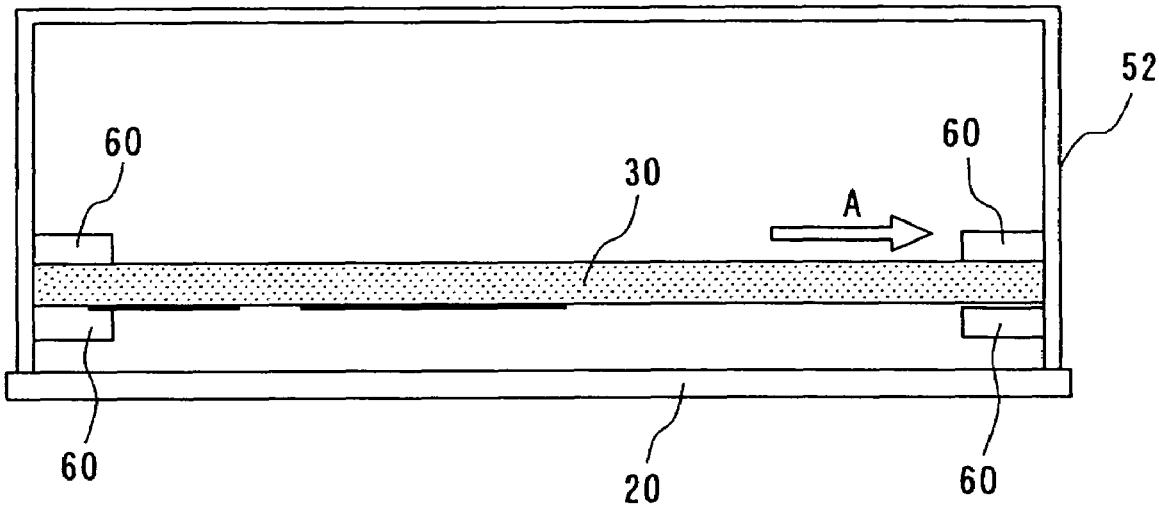
FIG. 10A shows the structure in which the dielectric substrate is held by a tongue folding mechanism.
Figure 10B:
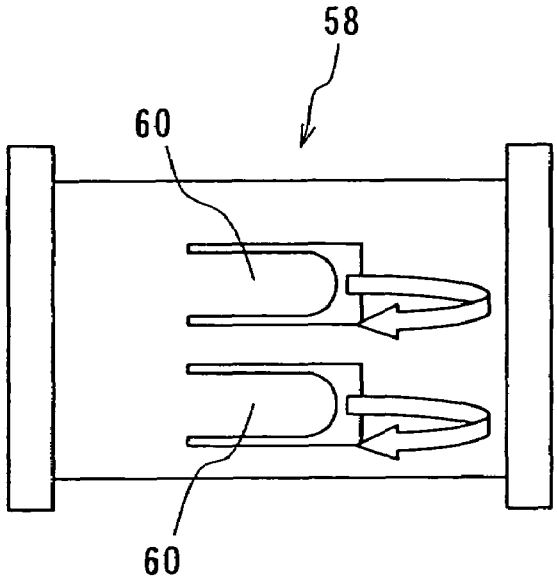
FIG. 10B is a plan view of the tongue folding mechanism prior to a folding step of the tongue.

FIG. 10A shows the structure in which a tongue folding mechanism 58 is provided on the inner wall of the frame 52, a tongue 60 is folded inwardly, and the dielectric substrate 30 is held between the folded tongues 60. FIG. 10B is a plan view of the tongue folding mechanism 58 prior to a folding step of the tongue.

Figure 11:
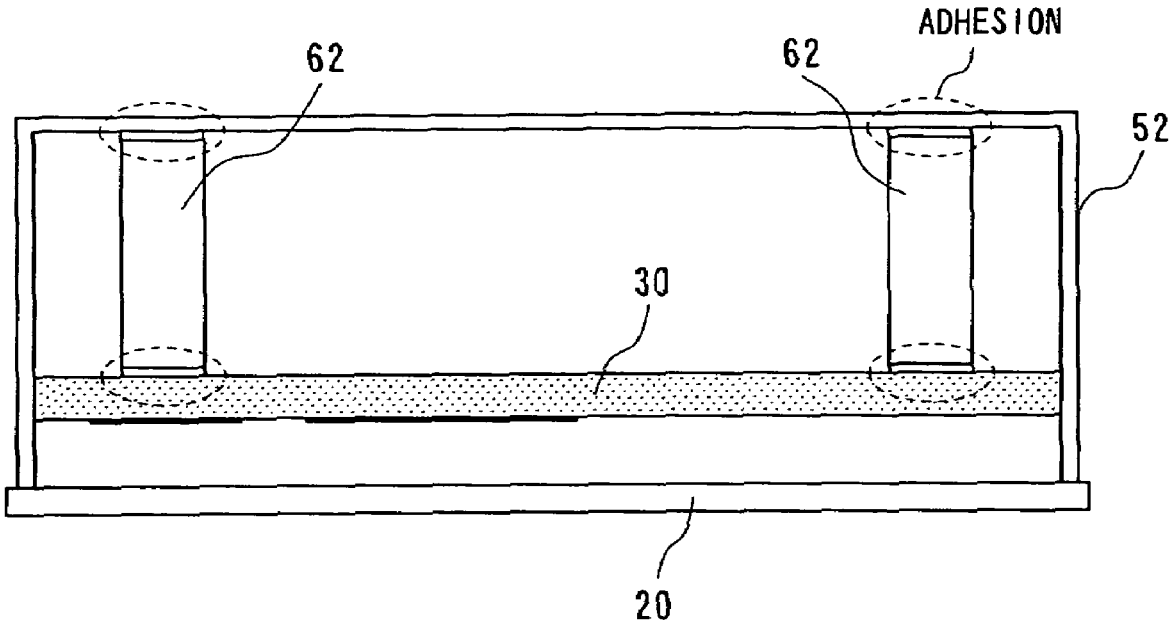
FIG. 11 shows the structure in which the dielectric substrate is held by spacers.

FIG. 11 shows the structure in which the dielectric substrate 30 is fixed to the frame 52 via spacers 62 each made of the material of a low dielectric constant, the both ends the spacers being adhered to the ceiling of the frame 52 and the dielectric substrate 30, respectively.

In various structures described above, since the dielectric substrate 30 is fixed to the cavity module by various fixing means, the distance between the planar antenna and the capacitive feeding elements may be held at a predetermined value when the cavity module is mounted on the window glass panel 20.

While the capacitive feeding elements are provided on the surface of the dielectric substrate at an antenna side, the capacitive feeding elements may be provided on the opposite surface of the dielectric substrate.

Figure 12:
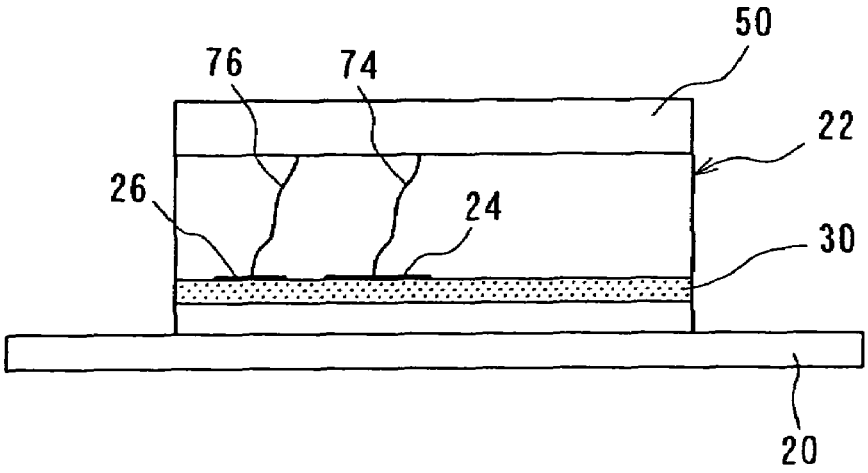
FIG. 12 shows another example of the feeding structure.

FIG. 12 shows a feeding structure in the case that the capacitive feeding elements 24 and 26 are provided on the surface of the dielectric substrate 30 opposite to the surface thereof at an antenna side. In this case, the capacitive feeding elements 24 and 26 may be connected directly to the amplifier 50 in the cavity module 22 through feeder 74 and 76, respectively. When a coaxial feeder is used as the feeders 74 and 76, the inner conductor of the coaxial feeder is connected to the capacitive feeding element 24 and the outer conductor thereof to the capacitive feeding element 26.

In the case that a coaxial feeder is used in the various embodiments described above, the connection of the inner and outer conductors of the coaxial cable to the feeding element 24 and 26 may be opposite if the frequency of a utilized signal is high. For example, the inner conductor of the coaxial feeder is connected to the capacitive feeding element 26 and the outer conductor thereof to the capacitive feeding element 24 in FIG. 12.

While the embodiments in which the hot antenna element of a planar antenna includes an opening have been described, the present invention is applicable to a planar antenna, the hot antenna element thereof does not include an opening.

The invention claimed is:

1. A feeding structure of an antenna device for a motor vehicle for feeding a planar antenna including a hot antenna element and a ground antenna element formed on one surface of a window glass panel for the motor vehicle from a cavity module, the module being mounted on the window glass panel so as to cover the planar antenna, comprising:

a dielectric substrate fixed in the module;

a first capacitive feeding element provided on the surface of the dielectric substrate and opposed to the hot antenna element; and a second capacitive feeding element provided on the surface of the dielectric substrate and opposed to the ground antenna element;

wherein air is present between the dielectric substrate and the planar antenna.

2. A feeding structure of an antenna device for a motor vehicle for feeding a planar antenna including a hot antenna element and a ground antenna element formed on one surface of a window glass panel for the motor vehicle from a cavity module, the module being mounted on the window glass panel so as to cover the planar antenna, comprising:

a dielectric substrate fixed in the module;

a first capacitive feeding element provided on one surface of the dielectric substrate at an antenna side and opposed to the hot antenna element; and a second capacitive feeding element provided on the one surface of the dielectric substrate and opposed to the ground antenna element;

first and second connecting lands for a feeder provided on an other surface of the dielectric substrate;

a first conductive path formed in the dielectric substrate for connecting the first capacitive feeding element to the first connecting land; and a second conductive path formed in the dielectric substrate for connecting the second capacitive feeding element to the second connecting land;

wherein air is present between the dielectric substrate and the planar antenna.

3. A feeding structure according to claim 2, wherein the first and second conductive paths are composed of conductors provided on a side wall of one elongated opening opened in the dielectric substrate.

4. A feeding structure according to claim 2, wherein the first and second conductive paths are composed of conductors provided on a side wall of at least one through hole opened in the dielectric substrate.

5. A feeding structure of an antenna device for a motor vehicle for feeding a planar antenna including a hot antenna element and a ground antenna element formed on one surface of a window glass panel for the motor vehicle from a cavity module, the module being mounted on the window glass panel so as to cover the planar antenna, comprising:

a dielectric substrate fixed in the module;

a first capacitive feeding element provided on one surface of the dielectric substrate at an antenna side and opposed to the hot antenna element; and a second capacitive feeding element provided on the one surface of the dielectric substrate and opposed to the ground antenna element;

one penetrating hole opened in the dielectric substrate; and a feeder provided passing through the penetrating hole so as to be connected to the first and second capacitive feeding elements;

wherein air is present between the dielectric substrate and the planar antenna.

6. A feeding structure of an antenna device for a motor vehicle for feeding a planar antenna including a hot antenna element and a ground antenna element formed on one surface of a window glass panel for the motor vehicle from a cavity module, the module being mounted on the window glass panel so as to cover the planar antenna, comprising:

a dielectric substrate fixed in the module;

a first capacitive feeding element provided on one surface of the dielectric substrate at an opposite side to the planar antenna, the first capacitive feeding element being opposed to the hot antenna element;

a second capacitive feeding element provided on the one surface of the dielectric substrate, the second capacitive feeding element being opposed to the ground antenna element;

wherein air is present between the dielectric substrate and the planar antenna.

7. A feeding structure according to any one of claims 1-6, wherein the dielectric substrate is fixed to a frame of the module by a holding member.

8. An antenna device for a motor vehicle, comprising:

a planar antenna including a hot antenna element and ground antenna element formed on one surface of a window glass panel for the motor vehicle; and a feeding structure according to any one of claims 1-6.

9. An antenna device for a motor vehicle, comprising:

a planar antenna including a hot antenna element and ground antenna element formed on one surface of a window glass panel for the motor vehicle; and a feeding structure according to claim 7.

10. A feeding structure according to any one of claims 1-6, wherein the planar antenna is provided on an inner surface of the window glass panel.

11. A feeding structure according to claim 7, wherein the planar antenna is provided on an inner surface of the window glass panel.

12. An antenna device for a motor vehicle, comprising:

a planar antenna including a hot antenna element and ground antenna element formed on one surface of a window glass panel for the motor vehicle; and a feeding structure according to claim 11.

13. An antenna device for a motor vehicle, comprising:

a planar antenna including a hot antenna element and ground antenna element formed on one surface of a window glass panel for the motor vehicle; and a feeding structure according to claim 10.

* * * * *